United States Patent [19]

Hilfiker

[11] Patent Number: 4,856,939

[45] Date of Patent: Aug. 15, 1989

[54] METHOD AND APPARATUS FOR CONSTRUCTING GEOGRID EARTHEN RETAINING WALLS

[76] Inventor: William K. Hilfiker, 3900 Broadway, Eureka, Calif. 95501

[21] Appl. No.: 291,182

[22] Filed: Dec. 28, 1988

[51] Int. Cl.[4] ..... E02D 29/02

[52] U.S. Cl. ..... 405/284; 405/258

[58] Field of Search ..... 405/258, 262, 272, 284, 405/285, 286, 287

[56] References Cited

U.S. PATENT DOCUMENTS

| | | | |
|---|---|---|---|
| 4,117,686 | 10/1978 | Hilfiker | 405/284 |
| 4,329,089 | 5/1982 | Hilfiker et al. | 405/262 |
| 4,505,621 | 3/1985 | Hilfiker et al. | 405/284 |
| 4,530,622 | 7/1985 | Mercer | 405/258 |
| 4,643,618 | 2/1987 | Hilfiker et al. | 405/287 |
| 4,728,227 | 3/1983 | Wilson | 405/284 |

FOREIGN PATENT DOCUMENTS 75 07114 10/1976 France .

OTHER PUBLICATIONS

The Heavy Duty Geogrid Wall, *Civil Engineering,* May 1988, pp. 75–77.

*Primary Examiner*—David H. Corbin

*Attorney, Agent, or Firm*—Limbach, Limbach & Sutton

[57] ABSTRACT

A retaining wall for an earthen formation relies on polymer geogrids for earth reinforcement and wire trays to provide the face of the formation. The wire trays are of L-shaped with intersecting floor and face sections. Hooked extensions formed on the face sections serve to secure the trays in superimposed relationship within the retaining wall and to hold the geogrids in place against the trays. The geogrids extend distally from the trays to provide deep reinforcement of the earthen formation.

10 Claims, 3 Drawing Sheets

METHOD AND APPARATUS FOR CONSTRUCTING GEOGRID EARTHEN RETAINING WALLS

BACKGROUND OF THE INVENTION

The present invention relates to the retention of earthen formations and, more particularly, is concerned with a retaining and reinforcing mechanism wherein the earthen formation is reinforced by a polymer geogrid and the face of the formation is retained both by the geogrid and a welded wire tray secured to the geogrid. In its more specific aspects, the invention is concerned with such a mechanism wherein the welded wire trays have face sections with preformed hooks which serve both to secure the geogrids in place and secure the trays within a formation in superimposed relationship to one another.

The use of welded wire trays to reinforce earthen formations and provide retaining walls therefor is well known. U.S. Pat. No. 4,117,686 discloses such a wall wherein superimposed trays are tied together with separate ties which are wrapped therearound. U.S. Pat. No. 4,505,621 discloses such a wall wherein the face section of each tray is formed with kinked extensions which secure each tray to the face section of the tray thereabove. Another form of wire retention wall may be seen in French Patent No. 7,507,114, published Oct. 1, 1976. In the structure of the latter patent, wire trays have U-shaped face sections which are superimposed upon one another and, in at least some instances, secured together with wire ties.

The prior art also teaches earthen retaining walls comprised of soil reinforced with polymer geogrids. An example of such a wall may be found in U.S. Pat. No. 4,728,227. In the wall of that patent, the geogrids are secured to concrete panels at the face of the formation.

SUMMARY OF THE INVENTION

The principal component of the invention is a structure comprised of a welded wire steel tray having a polymer geogrid secured thereto. The tray is defined by an upstanding face section with a floor section extending from one side thereof and a cross-rod extending thereacross at the intersection of the floor and face sections. Hook-shaped wires extend from the distal end of the face section to secure the geogrid to the face section and provide for the securing of the tray to the cross-rod of a like tray stacked thereabove. The geogrid extends from hooked engagement with the wires over the internal surface of the tray and from the distal end of the floor section thereof.

In practice of the method, the structures are superimposed one above the other, with the floor sections of the respective structures in generally parallel relationship to one another and the hook-shaped wires of each structure hooked over the cross-rod at the fold line of the structure immediately thereabove. The resulting retaining wall comprises a plurality of the structures superimposed upon one another, with the face sections of the trays for the respective structures secured together by the hook-shaped wires and the geogrids extending into the formation to be reinforced and retained.

A principal object of the present invention is to provide a reinforced soil retaining wall wherein welded wire steel trays provide the face of the wall and polymer geogrids provide a backing for the face and for soil reinforcement.

A further object of the invention is to provide such a wall wherein the geogrids will retain the face of an earthen formation even if the welded wire steel trays are corroded away.

Another object of the invention is to provide such a wall wherein the steel trays and polymer geogrids are secured together to work conjointly.

Still another object of the invention is to provide such a wall wherein the steel trays include hooked portions which serve to both secure the polymer geogrids thereto and fasten successive trays within the wall together.

Yet another and more general object of the invention is to provide such a wall wherein the steel trays provide a face which is not subject to deterioration by ultraviolet light and the polymer geogrids provide a soil reinforcing structure which is not subject to degradation by corrosion.

Still another object of the invention is to provide such a wall wherein standard commercially available geogrid material may be employed, without modification.

A further object of the invention is to provide such a wall wherein the trays may be prefabricated remote from the situs of the wall and later incorporated into the wall, without the employment of special tools or separate ties.

Still another and more specific object of the invention is to provide such a wall wherein the face elements of the wall may be secured together, without the necessity of separate ties which must be wrapped therearound and plastically deformed.

Another object of the invention is to provide such a wall wherein the trays are stacked and each tray displacement during backfilling.

These and other objects will become more apparent when viewed in light of the following detailed description and accompanying drawings.

DESCRIPTION OF THE FIRST EMBODIMENT

Figure 2:
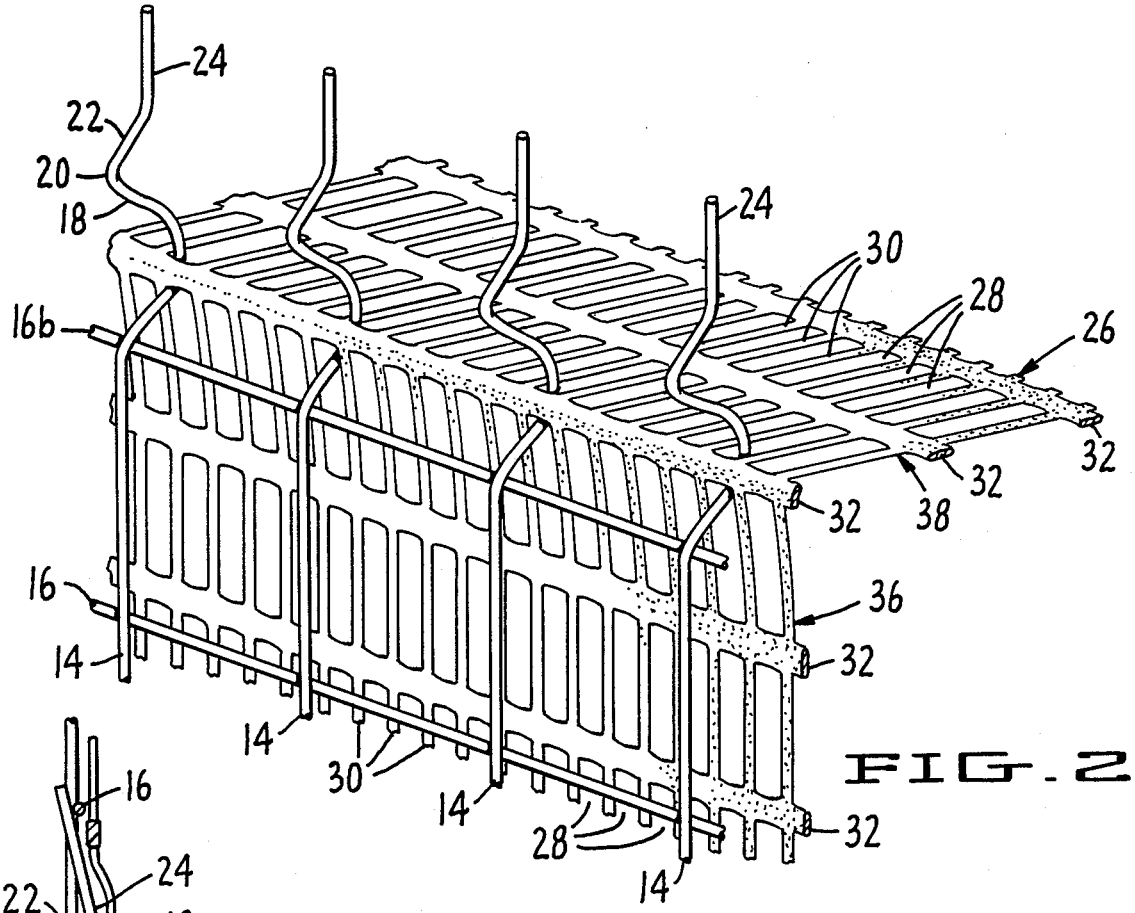
FIG. 2 is a perspective view, with parts thereof broken away and shown in section, illustrating the manner in which the steel wire tray embodied in the first embodiment wall is secured to the polymer geogrid.
Figure 1:
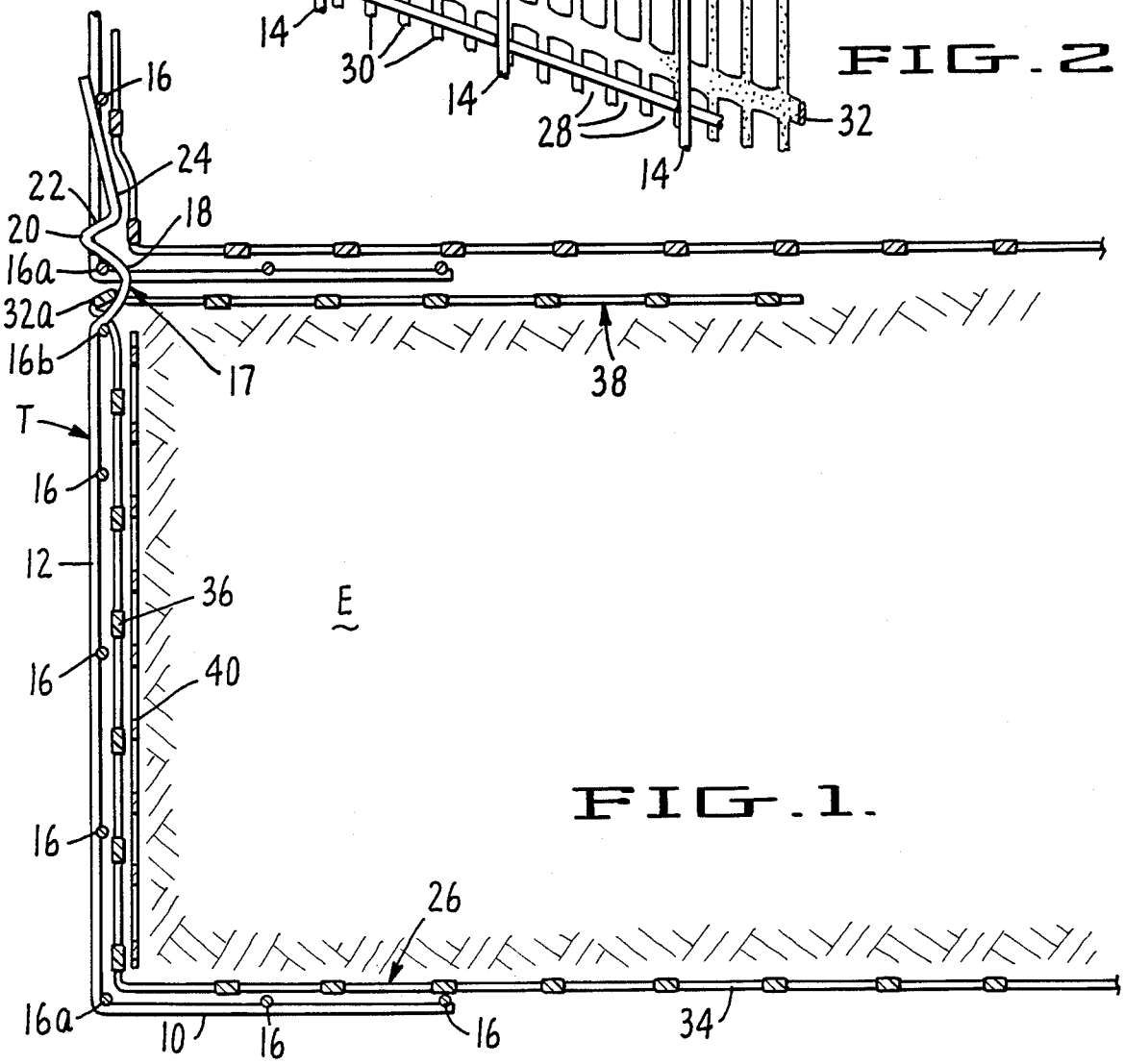
FIG. 1 is a cross-sectional elevational view through a portion of an earthen formation which has been soil-reinforced and retained by a first embodiment wall constructed according to the present invention.

Referring now to FIGS. 1 and 2, an earthen formation "E" is shown retained by a wall constructed according to the first embodiment of the present invention. The wall comprises a plurality of generally L-shaped welded wire grid work trays "T", each of which has a floor section 10 and a face section 12. The floor section 10 extends from the rear side of the face section 12 into the formation "E". In a typical embodiment, the trays are fabricated of 5, 7 or 9 gage wire, having 6×6 inch spacing and the wires within the trays are coated with an anticorrosive coating, such as galvanizing, zinc dip or epoxy.

Each tray "T" comprises longitudinally extending wires 14 extending continuously over the length thereof and across the floor and face sections in spaced generally parallel relationship to one another. Transverse or cross-wires 16 are welded to and extend across the longitudinally extending wires 14. In the preferred embodiment illustrated, one of the cross-wires is a corner wire 16*a* disposed at the fold line between the floor and face sections. Another of said cross-wires, designated 16*b*, is disposed at the distal end of the face section.

Each longitudinally extending wire 14 has an extension 17 extending from the distal cross-wire 16*b*. The extension comprises a concave portion 18 extending back from the plane of the face section 12; a convex portion 20 extending forwardly from the concave portion 18 and terminating in generally coplanar relationship with the face section 12; an inward extension portion 22 extending back from the convex portion 20; and a distal end portion 24 extending upwardly and forwardly from the extension portion 22. An elongate polymer geogrid 26 extends over the inside of the face section 12 and the top of the floor section 10. The geogrid may take any suitable commercially available form, such as that sold by the Tensar Corporation of Atlanta, Ga. under the trademark TENSAR. TENSAR geogrids are a high tensile strength, chemically inert, polymer grid developed specifically for long term (120 years) soil reinforcement applications. As may be seen from FIG. 2, the geogrid includes a plurality of spaced apart generally elongate apertures 28 aligned into transversely extending rows which proceed down the length of the geogrid. Each aperture 28 is spaced from the next adjacent aperture by a web 30. Each row of apertures is separated from the next adjacent row by a rill 32 which is somewhat thicker than the body of the grid as a whole.

The geogrid 26 comprises a bottom length 34 extending over the floor section 10 and beyond the free distal end thereof into the earthen formation "E"; a front length 36 extending upwardly from the bottom length and terminating in a corner rill 32*a* hooked over the extension 17 so as to be received within the concave portion 18 thereof; and a top length 38 extending back from the rill 32*a* and into the earthen formation "E". It will thus be seen that the concave portion 18 functions to secure the geogrid to the wire tray "T".

In a typical embodiment, the floor section 10 is about 10 inches in depth measured from the corner wire 16*a* to the wire 16 at the distal end of the section; and the face section 12 is about 24 inches in height measured from the corner wire 16*a* to the top wire 16*b*. The exact dimensions may vary, depending upon the size of the wall being constructed. The bottom length 34 of the geogrid extends beyond the floor section of the tray and ideally extends back into the formation to a depth of approximately 80 percent of the composite height of the wall being constructed. The front length 36 has a height dimension approximately equal to that of the face section 12 of the tray "T". The top length 38 typically has a depth dimension extending back into the earthen formation of approximately 30 inches. This length serves to secure the top end of the tray "T" to the earthen formation. A polymer screen 40 of a size generally commensurate with that of the front length 36 overlays the front length to the inside thereof. The screen may be of any suitable relatively fine mesh type, such as that available through the Tensar Corporation. Its purpose is to prevent the soil in the earthen formation "E" from filtering through the face section of the wall.

In use, the earthen formation to be retained would be first be excavated to provide for placement of the wall. The lowermost tray "T" and the geogrid therefor would then be positioned at the bottom of the excavated area, with the front and bottom lengths of the geogrid disposed generally as shown in FIG. 1 and rill 32*a* hooked over the extensions 7. The screen 40 would then be placed behind the front length 36 and back fill would be filled in over the bottom length 34 and compacted to approximately the level of the distal cross-wire 16*b*. The top length 38 of the geogrid would then be laid back over the earthen fill and the next successive tray and geogrid would be placed as shown in FIG. 1. During the latter placement, the cross-wire 16*a* at the fold line of the next successive tray would be engaged within the concave portions 18 of the tray therebeneath, thereby securing the trays together, and the distal end portions 24 would be engaged behind the cross-wire 16 of the next successive tray (see FIG. 1) to restrain that tray from outward movement relative to the tray therebeneath during the backfilling operation. The process of placing the screen 40 for the next successive tray and back filling would then be repeated. Then a third and as many successive levels of trays and back fill would be similarly placed until the desired composite height of the wall was achieved. When the topmost level of the wall was reached, a tray of generally the same construction as the tray "T" would be inverted so as to hook over the top edge of the topmost tray of the wall and extend back into the earthen formation, thus anchoring the distal top edge of the wall.

DESCRIPTION OF THE SECOND EMBODIMENT

Referring now to FIGS. 3 to 7, an earthen formation "E" is shown in the process of being retained by a wall constructed according to the second embodiment of the present invention. The wall comprises a plurality of generally L-shaped welded wire gridwork trays "$T_1$", each of which has a floor section 42 and a face section 44. The trays "$T_1$" are fabricated of welded wire of the same type and proportions used for the trays "T" of the first embodiment. Like the trays "T", the wires within the trays "$T_1$" may be coated an anti-corrosive coating, such as galvanizing, zinc dip or epoxy.

Each tray "$T_1$" comprises longitudinally extending wires 46 extending continuously over the length thereof and across the floor and face sections in spaced generally parallel relationship to one another. Transverse or cross-wires 48 are welded to and extend across the longitudinally extending wires 46. In the preferred embodiment illustrated, one of the crosswires is a corner wire 48*a* disposed at the fold line between the floor and face sections. Another of said cross-wires, designated 48*b*is disposed at the distal end of the face section.

Figure 7:
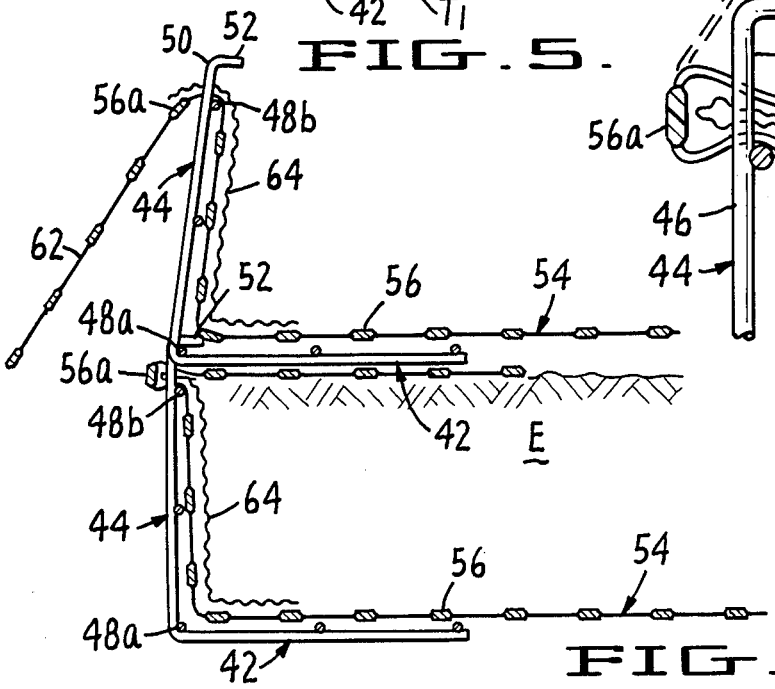

Each longitudinally extending wire 46 has an extension 50 extending from the distal cross-wire 48*b*. The extension includes a hook section 52 extending back from the plane of the face section 44 for engagement over the cross-wire 48*a* of the next successive tray (See. FIG. 7). An elongate polymer geogrid 54 extends over the inside of the face section 44 and the top of the floor section 42. The geogrid is of a construction corresponding to that of the geogrid 26 and includes rows of apertures separated from each other by transverse rills 56.

The geogrid 54 comprises a bottom length 58 extending over the floor section 42 and beyond the free distal end thereof into the earthen formation "E"; a front length 60 extending upwardly from the bottom length; a corner rill 56*a* hooked over the extension 50; and a top length 62 extending back from the rill 58*a* and into the earthen formation "E".

Figure 3:
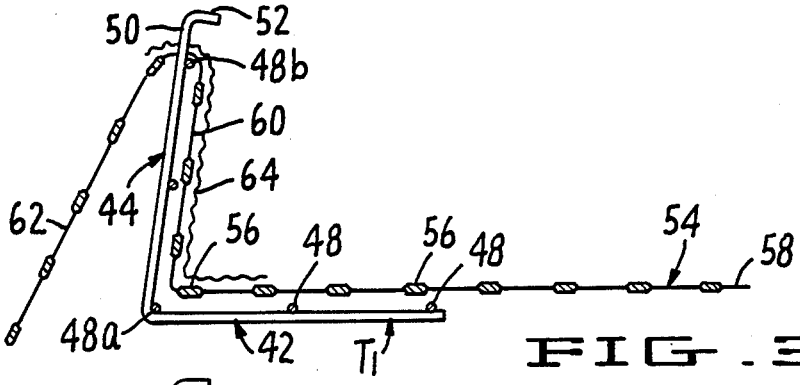
FIGS. 3 to 7 are cross-sectional elevational views through a second embodiment wall constructed according to the present invention, illustrating the sequence of steps used to construct the wall.
Figure 4:
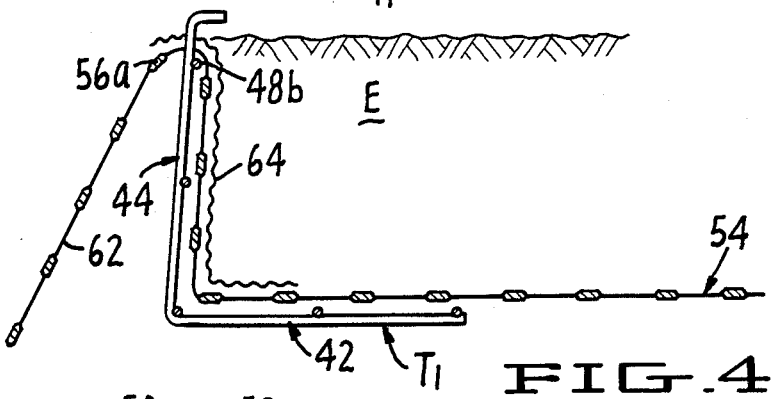

In use, the earthen formation to be retained would first be excavated to provide for placement of the wall. The lowermost tray "$T_1$" would then be positioned at the bottom of the excavated area as shown in FIG. 3, with the rill 56*a* hooked over the extensions 50 and a filter screen 64 extended over the back side of the front length 60. Backfill would then be placed and compacted over the lowermost tray as shown in FIG. 4 to approximately the level of the cross-wire 48*b*. The top length 62 would then be folded back over the backfill, while maintaining the corner rill 56*a* hooked over the extension 50 to the forward side of the face section 44. (See FIGS. 5 and 6).

Figure 5:
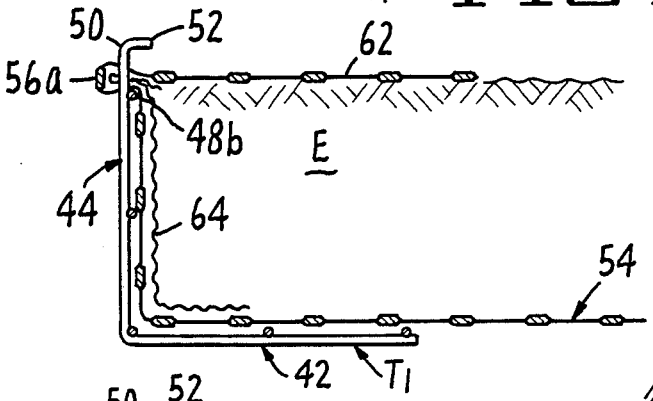
Figure 6:
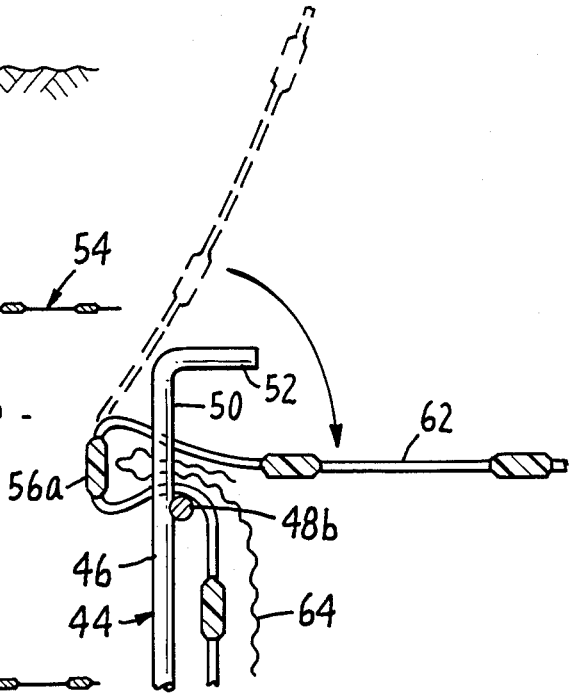

After completion of the first course of trays to the condition shown in FIG. 5, successive courses are placed thereabove as shown in FIG. 7. The trays of each successive course are slid behind the extensions 50 of the trays therebelow so that the cross-wires 48*a* of the successive trays are engaged beneath the hook sections 52 of the trays therebeneath. Thus, each lower tray serves to secure the tray immediately thereabove against outward displacement. After each successive course of trays is so placed, the steps of installing the geogrid 44, placing the filter screen 64 and backfilling are repeated therefor as shown in FIGS. 4 and 5. Then the top length of the geogrid is folded back over the fill and the next successive course of trays is placed.

The face sections 44 of the trays "$T_1$" initially form an acute angle of approximately 85° with respect to the floor sections 42. This may be seen from FIG. 3 and the topmost course of trays shown in FIG. 7. As the earthen formation "E" is backfilled behind a tray and compacted, the face section 44 bends to a condition generally normal to the floor section 44, as may be seen from FIG. 5 and the bottom course of trays shown in FIG. 7. This bending takes place within the elastic limit of the material of the trays "$T_1$". It has the advantage that the resulting wall has a generally vertical face, even though the face sections 44 of the respective trays have been bent outwardly under the load of the earthen fill therebehind.

DESCRIPTION OF THE ILLUSTRATED PRIOR ART WALLS

FIGS. 8 to 11 show prior art reinforced soil walls embodying a combination of welded wire steel trays and polymer geogrids. These walls do not embody the hooked configuration of the trays of the present invention which serve both to secure successive trays together and secure the geogrids to the trays.

Figure 8:
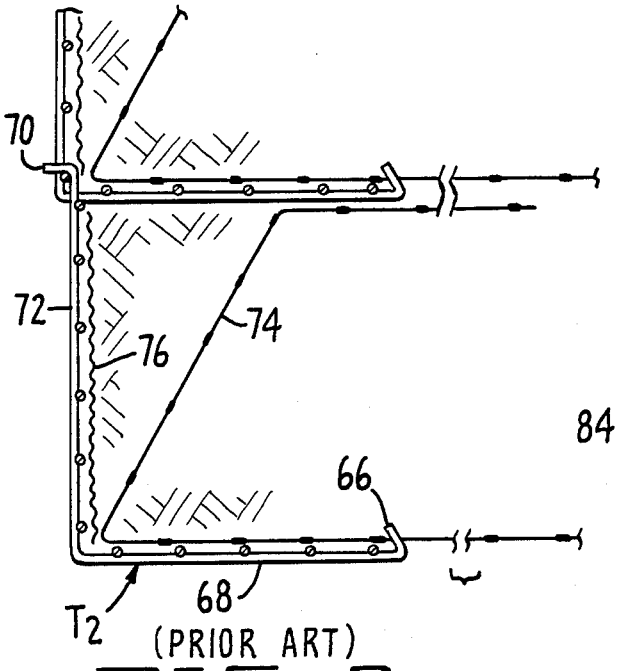
(PRIOR ART) FIG. 8.
FIG. 8 is a cross-sectional elevational view through a portion of an earthen formation which has been soil reinforced and retained by a first prior art wall embodying a combination of welded wire trays and polymer geogrids.

The wall shown in FIG. 8 has welded wire trays "$T_2$" with first hooks 66 at the distal end of the floor section 68 and second hooks 70 at the distal end of the face section 72. A polymer geogrid 74 extends behind each of the trays and is hooked over the hooks 66. A screen 76 is disposed against the face section 72 to the inside of the geogrid. When assembled into a composite wall as shown in FIG. 8, the hooks 70 of each tray engage over and extend forwardly of a cross-wire of the next successive tray.

Figure 9:
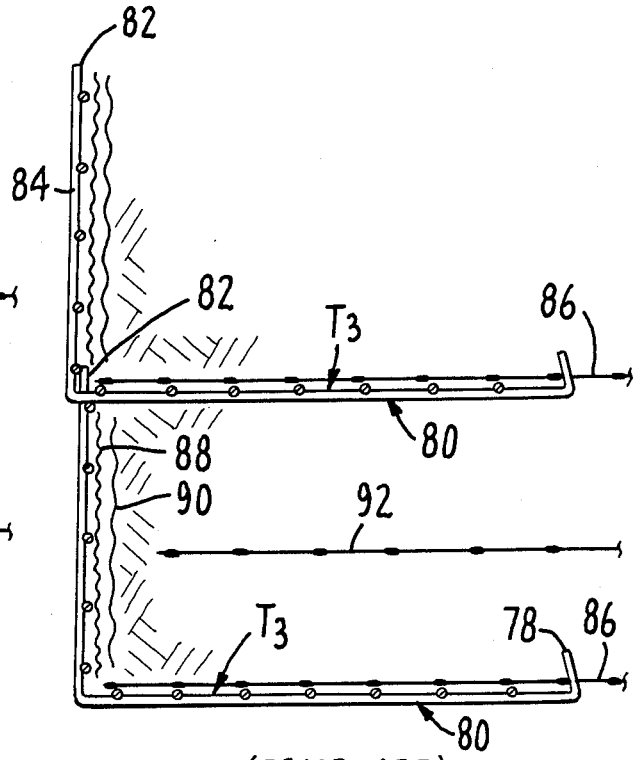
(PRIOR ART) FIG. 9.
FIG. 9, is a cross-sectional elevational view through a portion of an earthen formation which has been soil reinforced and retained by a second prior art wall embodying a combination of welded wire trays and polymer geogrids.

The wall shown in FIG. 9 has welded wire trays "$T_3$" with hooks 78 at the distal end of the floor section 80 and wire extensions 82 at the distal end of the face section 84. A flat polymer geogrid 86 is hooked over the hooks 86 and extends into the earthen formation being reinforced. Screens 88 and 90 are disposed to the inside of the face sections 84. Additional geogrids 92 are disposed within the earthen formation being reinforced, in a condition disconnected from the trays "$T_3$". When assembled into a composite wall as shown in FIG. 9, the extensions 82 of the tray extend behind the face section of the next successive tray.

Figure 10:
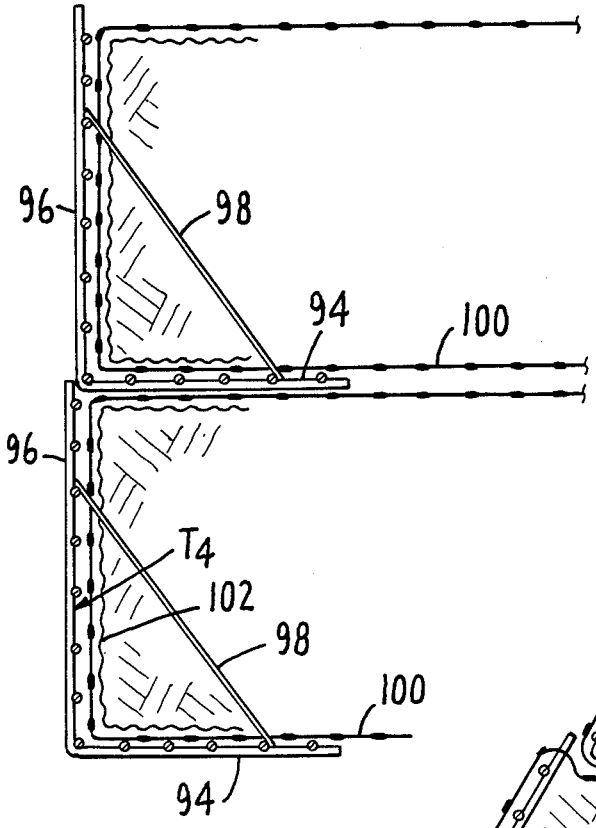
(PRIOR ART) FIG. 10.
FIG. 10 is a cross-sectional elevational view through a portion of an earthen formation which has been soil reinforced and retained by a third prior art wall embodying a combination of welded wire trays and polymer geogrids; and, FIG. 11 is a cross-sectional elevational view through a portion of an earthen formation which has been soil reinforced and retained by a fourth prior art wall embodying a combination of welded wire trays and polymer geogrids.

The wall shown in FIG. 10 has welded wire trays "$T_4$", each of which has a floor section 94 and a face section 96. Bracing ties 98 secure the floor and face sections of each tray together and against separation. Polymer geogrids 100 extend across the face section of each tray and back into the earthen formation being reinforced. No hooked connections between the geogrids and trays are provided. Screens 102 are disposed to the inside of the geogrid 100. When assembled into a composite wall as shown in FIG. 10, the upper extremity of the face section of each tray extends to the front of the next successive tray thereabove.

Figure 11:
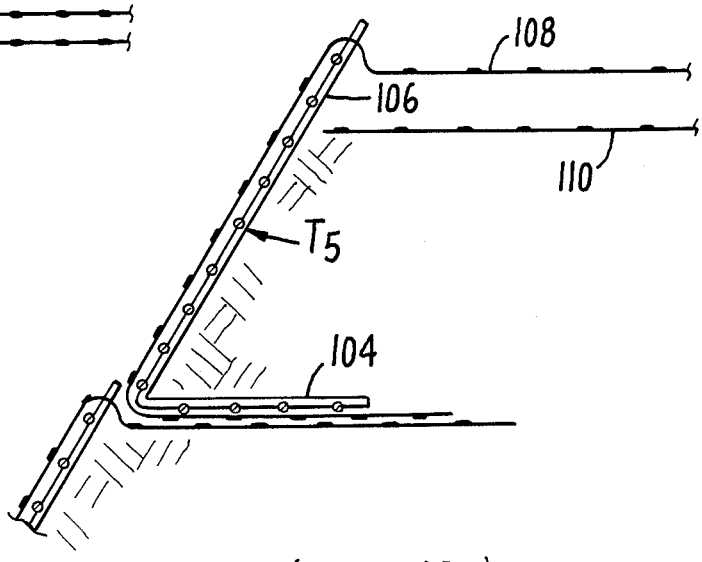
(PRIOR ART) FIG. 11.

The wall shown in FIG. 11 has welded wire trays "$T_5$", each of which has a floor section 104 and a face section 106. A polymer geogrid 108 is wrapped around each tray and extends back therefrom into the earthen formation being reinforced. Additional geogrids 110 are disposed within the formation in a condition disconnected from the trays "$T_5$". When assembled into a composite wall as shown in FIG. 11, the successive trays with the geogrid wrapped therearound are simply stacked upon one another.

Conclusion

Each geogrid of the invention functions both to reinforce the earthen formation within which it is impacted and to anchor the top of the tray over which it is hooked. The composite wall thus provided has an outer face defined by the steel face sections and an earthen reinforcing structure defined by the geogrids. The face sections of each course of trays serve to secure the trays thereabove from outward displacement during the backfilling operation.

The invention may depart from the specifics of the preferred embodiment illustrated. For example, the top lengths of a geogrid may be omitted where it is found that the top end of the face section secured to the geogrid is adequately anchored by the next successive tray engaged therewith. Accordingly, it should be understood that the invention is not limited to the specifics of the embodiment illustrated and described, but rather is defined by the accompanying claims.

I claim:

1. A retaining wall structure comprising:

(a) a generally rectangular steel wire tray defined by an upstanding face section with a floor section extending from one side thereof, said tray having longitudinal rods extending continuously over the length thereof in spaced generally parallel relationship to one another and cross-rods welded to and extending transversely across said longitudinal rods in spaced relationship to one another, said sections intersecting at a fold line having one of said cross-rods extending thereacross and each having a free distal end;

(b) a plurality of wires fixed to and extending from the distal end of the face section, said wires being elongate and each having a hook portion extending back from the side of the face section from which the floor section extends; and, (c) an elongate polymer geogrid extending over the side of the face section from which the floor section extends and over the top of the floor section, said geogrid extending beyond the free distal end of the floor section and having a proximal portion with a cross-element hooked over said wires and received within the hook portions thereof.

2. A structure according to claim 1 wherein the proximal portion of the geogrid extends beyond the element hooked over said wires and back from the side of the face section from which the floor section extends.

3. A structure according to claim 1 wherein said wires each have a convex portion extending distally from the hook portion thereof.

4. A structure according to claim 3 wherein:

(a) the face section is planar; and, (b) the convex portion extends outwardly to generally coplanar relationship with the face section and then back from the side of the face section from which the floor section extends.

5. A structure according to claim 4 wherein said wires each have an extension extending distally from the convex portion thereof for engagement in front of a cross-rod of a like tray superimposed thereabove.

6. A method of constructing a retaining wall for earthen formations, said method comprising the steps of:

(1) providing a plurality of structures each comprising:

(a) a generally rectangular steel wire tray defined by an upstanding face section with a floor section extending from one side thereof, said tray having longitudinal rods extending continuously over the length thereof in spaced generally parallel relationship to on another and cross-rods welded to and extending transversely across said longitudinal rods in spaced relationship to one another, said sections intersecting at a fold line having one of said cross-rods extending thereacross and each having a free distal end;

(b) a plurality of wires fixed to and extending from the distal end of the face section, said wires being elongate and each having a hook portion extending back from the side of the face section from which the floor section extends; and, (c) an elongate polymer geogrid extending over the side of the face section from which the floor section extends and over the top of the floor section, said geogrid extending beyond the free distal end of the floor section and having a proximal portion with a cross-element hooked over said wires and received within the hook portions thereof;

(2) superimposing said structures one above the other within an earthen formation with the floor sections of the respective structures in generally parallel relationship to one another and the hook portions of the wires of each structure hooked over the cross-rod at the fold line of the structure immediately thereabove.

7. A method according to claim 6 further comprising providing the proximal portion of at least certain of said geogrids with an extension extending beyond the element hooked over said wires and back from the side of the face section from which the floor section extends.

8. A method according to claim 6 wherein the floor and face sections intersect at an acute angle and as the structures are superimposed one above the other within an earthen formation the load of the formation against the face sections moves the face sections to a condition generally normal to the floor sections.

9. A retaining wall having, in combination, at least two structures comprising:

(a) a generally rectangular steel wire tray defined by an upstanding face section with a floor section extending from one side thereof, said tray having longitudinal rods extending continuously over the length thereof in spaced generally parallel relationship to one another and cross-rods welded to and extending transversely across said longitudinal rods in spaced relationship to one another, said sections intersecting at a fold line having one of said cross-rods extending thereacross and each having a free distal end;

(b) a plurality of wires fixed to and extending from the distal end of the face section, said wires being elongate and each having a hook portion extending back from the side of the face section from which the floor section extends; and, (c) an elongate polymer geogrid extending over the side of the face section from which the floor section extends and over the top of the floor section, said geogrid extending beyond the free distal end of the floor section and having a proximal portion with a cross-element hooked over said wires and received within the hook portions thereof; said structures being superimposed one above the other with the floor sections of the respective structures in generally parallel relationship to one another and the hook portions of the wires of each structure hooked over the cross-rod at the fold line of the structure immediately thereabove.

10. A retaining wall according to claim 9 wherein the proximal portion of the geogrid of at least certain of said structures extends beyond the element hooked over said wires and back from the side of the face section from which the floor section extends.

* * * * *